US012332033B2

(12) United States Patent
Sadler et al.

(10) Patent No.: US 12,332,033 B2
(45) Date of Patent: Jun. 17, 2025

(54) MUNITION WITH DIRECTIONAL PROJECTION EXPLOSIVE

(71) Applicant: Raytheon Company, Arlington, VA (US)

(72) Inventors: Coulton T. Sadler, Tucson, AZ (US); Brian J. Lukow, Tucson, AZ (US); Christopher Matthew Turner, Tucson, AZ (US)

(73) Assignee: Raytheon Company, Arlington, VA (US)

( * ) Notice: Subject to any disclaimer, the term of this patent is extended or adjusted under 35 U.S.C. 154(b) by 0 days.

(21) Appl. No.: 18/308,994

(22) Filed: Apr. 28, 2023

(65) Prior Publication Data

US 2024/0361110 A1 Oct. 31, 2024

(51) Int. Cl.

| | |
|---|---|
| ***F42B 12/20*** | (2006.01) |
| ***F42B 12/16*** | (2006.01) |
| ***F42B 12/32*** | (2006.01) |

(52) U.S. Cl.

CPC ..... *F42B 12/208* (2013.01); *F42B 12/16* (2013.01); *F42B 12/32* (2013.01)

(58) Field of Classification Search

CPC ..... F42B 12/208; F42B 12/16; F42B 12/32
USPC ..... 102/492
See application file for complete search history.

(56) References Cited

U.S. PATENT DOCUMENTS 3,796,158 A * 3/1974 Conger ..... F42B 12/204 102/701
3,978,796 A 9/1976 Hackman
4,745,864 A * 5/1988 Craddock ..... F42B 12/22 102/493
5,163,166 A * 11/1992 Adler ..... F42B 12/32 102/494
5,243,916 A * 9/1993 Freche ..... F42B 12/207 102/491
5,535,679 A * 7/1996 Craddock ..... F42B 12/32 102/389
5,691,502 A * 11/1997 Craddock ..... F42B 12/32 102/389
5,996,501 A * 12/1999 Spencer ..... C06B 45/12 102/292
7,743,707 B1 * 6/2010 Melin ..... F42B 12/24 102/493
8,061,275 B1 11/2011 Gold

FOREIGN PATENT DOCUMENTS

RU 2394203 C1 7/2010

* cited by examiner

*Primary Examiner* — Samir Abdosh
(74) *Attorney, Agent, or Firm* — Schwegman Lundberg & Woessner, P.A.

(57) ABSTRACT

A munition has an explosive charge with direction explosive characteristics, such as a nonuniform detonation velocities. The explosive charge may have multiple portions of explosives with nonuniform characteristics, and/or may have portions with graded nonuniform characteristics. The explosive charge may be used to propel a material from the munition in a desired manner. For example the material may be fragments that are part of a fragmentation munition. Alternatively the material may be a layer of a material, such as a metal, that produces an explosively formed penetrator or shaped charge. The explosive charge may be configured to control the spread and/or direction of the material to be propelled from the munition.

7 Claims, 6 Drawing Sheets

MUNITION WITH DIRECTIONAL PROJECTION EXPLOSIVE

FIELD

The disclosure is in the field of munitions.

BACKGROUND

Typical fragmenting warheads project fragments with well-known dispersion angles. Fragment mats and projector plates may be used to control dispersion.

SUMMARY

Known dispersion angles are often not ideal for defeat of certain targets in specific missions.

A munition uses a nonuniform directional explosive charge to project a material, such as fragments or an explosively formed penetrator.

Charges with multiple explosives with different detonation velocities may be used to alter the detonation wave front and ultimately alter fragment dispersion or penetrator direction and/or characteristics.

According to an aspect of the disclosure, a munition includes: a first explosive with a relatively high detonation velocity; and a second explosive with a relatively low detonation velocity, the relatively low detonation velocity being lower than the relatively high detonation velocity, and the second explosive being in contact with the first explosive.

According to an embodiment of any paragraph(s) of this summary, the munition further includes fragments operatively coupled to the first explosive and the second explosive, detonation of the first explosive and the second explosive propelling the fragments, with the munition being a fragmentation munition.

According to an embodiment of any paragraph(s) of this summary, the first explosive and the second explosive are configured to in combination propel the fragments in a desired pattern.

According to an embodiment of any paragraph(s) of this summary, the desired pattern includes a desired spread of the fragments.

According to an embodiment of any paragraph(s) of this summary, the desired pattern includes a desired direction.

According to an embodiment of any paragraph(s) of this summary, the fragments are on a face of the explosive charge.

According to an embodiment of any paragraph(s) of this summary, the fragments are on a perimeter of the explosive charge.

According to an embodiment of any paragraph(s) of this summary, the munition further includes a penetrator material layer operatively coupled to the explosive charge, with the munition being an explosively-formed penetrator or shaped charge munition.

According to an embodiment of any paragraph(s) of this summary, the penetrator material is a metal.

According to an embodiment of any paragraph(s) of this summary, the penetrator material is on a face of the explosive charge.

According to an embodiment of any paragraph(s) of this summary, the first explosive surrounds the second explosive.

According to an embodiment of any paragraph(s) of this summary, the second explosive surrounds the first explosive.

According to an embodiment of any paragraph(s) of this summary, the first explosive is fully embedded inside the second explosive.

According to an embodiment of any paragraph(s) of this summary, the second explosive is fully embedded inside the first explosive.

According to an embodiment of any paragraph(s) of this summary, at least one of the first explosive or the second explosive is axisymmetric.

According to an embodiment of any paragraph(s) of this summary, at least one of the first explosive or the second explosive is nonaxisymmetric.

According to an embodiment of any paragraph(s) of this summary, a boundary between the first explosive and the second explosive is sloped.

According to another aspect, a munition includes: an explosive charge that has a nonuniform detonation velocity; and a material that is propelled by the detonation of the explosive charge.

According to an embodiment of any paragraph(s) of this summary, the material includes fragments.

According to an embodiment of any paragraph(s) of this summary, the material includes a layer of materials that is propelled as an explosively formed penetrator.

According to an embodiment of any paragraph(s) of this summary, the explosive charge has graded detonation velocity.

According to yet another aspect, a method of configuring a munition includes the steps of: providing a material to be propelled from the munition; and configuring an explosive charge of the munition with a nonuniform detonation velocity, the explosive charge being operatively coupled to the material, to achieve a desired configuration of the material when propelled from the munition by detonation of the explosive charge.

While a number of features are described herein with respect to embodiments of the disclosure; features described with respect to a given embodiment also may be employed in connection with other embodiments. The following description and the annexed drawings set forth certain illustrative embodiments of the disclosure. These embodiments are indicative, however, of but a few of the various ways in which the principles of the disclosure may be employed. Other objects, advantages, and novel features according to aspects of the disclosure will become apparent from the following detailed description when considered in conjunction with the drawings.

BRIEF DESCRIPTION OF THE DRAWINGS

The annexed drawings, which are not necessarily to scale, show various aspects of the disclosure.

DETAILED DESCRIPTION

A munition has an explosive charge with direction explosive characteristics, such as a nonuniform detonation velocities. The explosive charge may have multiple portions of explosives with nonuniform characteristics, and/or may have portions with graded nonuniform characteristics. The explosive charge may be used to propel a material from the munition in a desired manner. For example the material may be fragments that are part of a fragmentation munition. Alternatively the material may be a layer of a material, such as a metal, that produces an explosively formed penetrator or shaped charge. The explosive charge may be configured to control the spread and/or direction of the material to be propelled from the munition.

Figure 1:
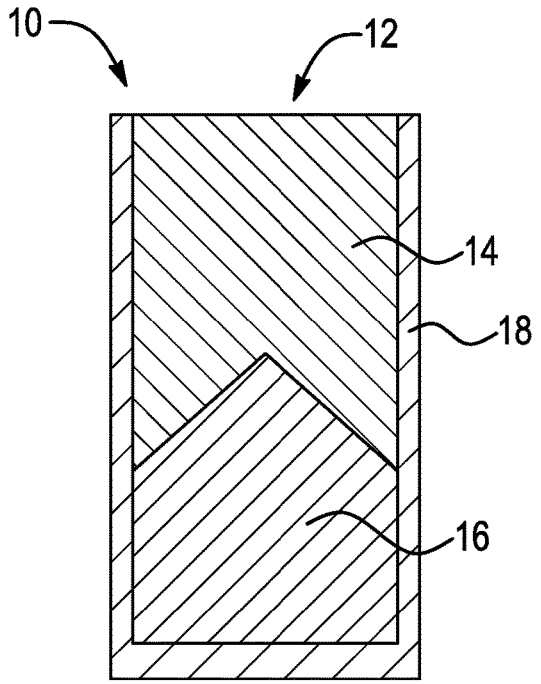
FIG. 1 schematically shows a munition according to an embodiment.

FIG. 1 schematically shows a munition 10 that has an explosive charge 12 has different explosive characteristics in different parts of the charge 12. For instance the explosive charge 12 may include a first explosive 14 in contact with a second explosive 16. The explosives 14 and 16 have different explosive characteristics, for example having different detonation velocities and/or different detonation pressures. A casing or housing 18 may enclose the charge 12, leaving one or more sides open, for example to direct the explosive force toward an open side. Such a housing may be part of other embodiments described below.

The explosive charge 12 may be configured to use the different explosive characteristics to provide desired directional characteristics due to the pressure from detonation of the explosive charge 12. For example the explosive charge 12 may be configured to provide desired spread and/or other directional characteristics to fragments or other projectiles that are operatively coupled to the explosive charge 12. The fragments may be located on an end surface of the charge 12, and/or may be located on a perimeter of the charge 12.

To give another example, the explosive charge 12 may be configured to provide directional characteristics to a material that is part of an explosively-formed penetrator or shaped charge. As still another example, the explosive charge 12 may be configure to output an explosive force directly in a desired direction. Some nonlimiting example embodiments are discussed below.

The explosive charge 12 may have any of a variety of shapes. The charge 12 may be cylindrical, for example, as may be the other explosive charges described below.

The different explosives 14 and 16 may have different compositions. They may have different explosive materials. Alternatively they may have the same basic explosive material, but with different additives, such as different amounts of binders and/or other nonexplosive additive materials. As another alternative, the different explosives 14 and 16 may have the same basic explosive material, but may have different (or different amounts) of explosive additive materials.

Suitable example explosive materials include PETN, PBXN-5 PBXN-9, PBXN-110, PBXN-109, PBXN-112, LX-14, Comp B, Comp A3 and Octol. For example, PBXN-5 may be used as a higher-detonation-velocity explosive, and PETN may be used as a lower-detonation-velocity explosive. Examples of suitable non-energetic materials include Viton, wax, and HTPB.

Munitions such as those described herein may be (or may be part of) a wide variety of weapons or devices. Examples include warheads, bombs, and missiles.

Figure 2:
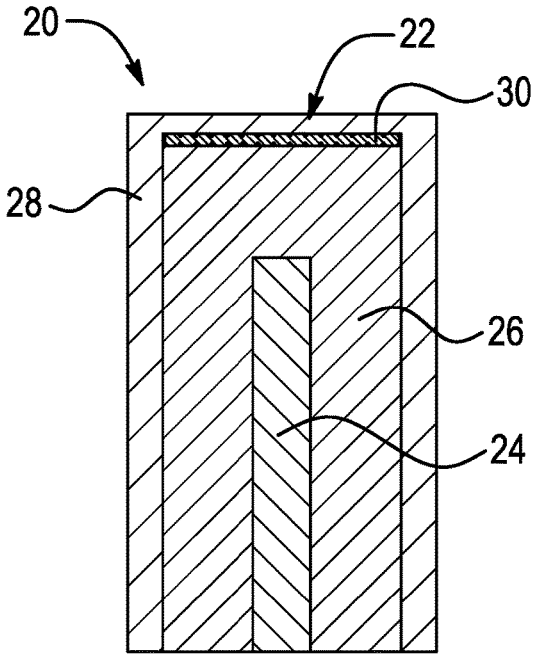
FIG. 2 shows a sectional view of a munition according to another embodiment.

FIG. 2 shows a munition 20 that has an explosive charge 22 that includes a central inner cylindrical explosive 24 centrally located within an outer explosive 26. The inner explosive 24 is a core within the outer explosive 26, with the outer explosive 26 extending fully over a face 28 on one end of the explosive charge 22. A series of fragments 30 are arrayed on the face 28.

Figure 3:
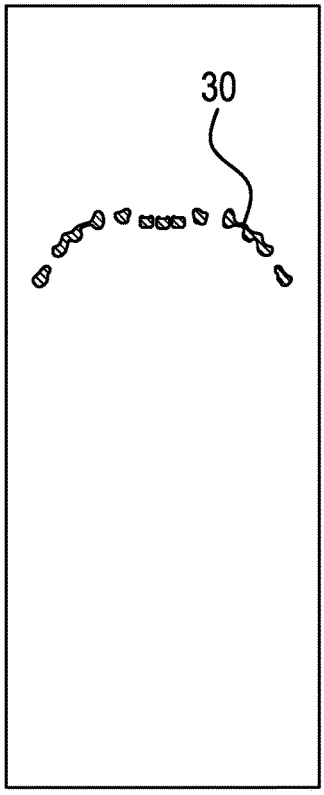
FIG. 3 illustrates a fragmentation pattern of one configuration of the munition of FIG. 2.

The inner explosive 24 may have a higher detonation velocity than that of the outer explosive 26. Upon detonation of the explosive charge 22 this configuration produces the array of fragments illustrated in FIG. 3, with a high concentration of the fragments 30 directed as the center of the fragment spread.

Figure 4:
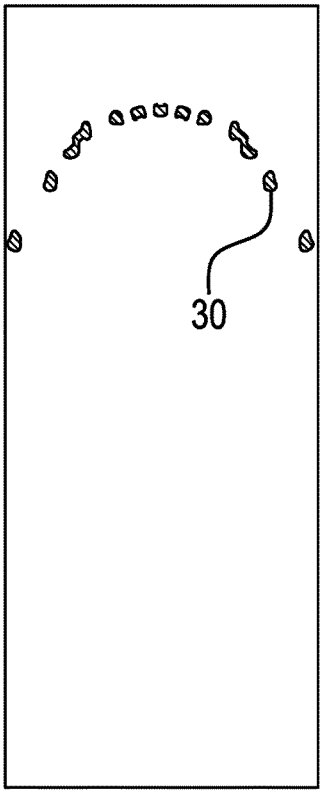
FIG. 4 illustrates a fragmentation pattern of another configuration of the munition of FIG. 2.

Alternatively the inner explosive 24 may have a lower detonation velocity than that of the outer explosive 26. Upon detonation of the explosive charge 22 this configuration produces the array of fragments illustrated in FIG. 4, with a wider spread of the fragments 30, with more uniform fragment flyout at the center of the fragment spread. The detonation wave arrives at the peripheral fragments 30 slightly before it arrives at the fragments 30 in the center, which nudges the peripheral fragments inward, toward the centerline, and balances out the natural tendency for the peripheral fragments to be skewed outward and flying at lower speed than the center fragments.

Suitable materials for the fragments include steel, tungsten, aluminum, tantalum, lead, titanium, zirconium, copper, molybdenum, magnesium, or other suitable materials, such as metals, alloys of such metals, and polymeric and reactive materials.

Figure 5:
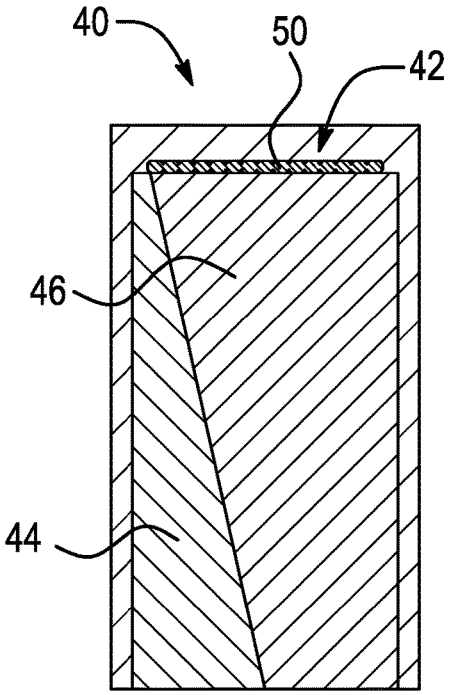
FIG. 5 shows a sectional view of a munition according to yet another embodiment.

FIG. 5 shows another configuration, a munition 40 having an explosive charge 42 with two explosives 44 and 46 having different detonation velocities. The explosives 44 and 46 have an angled interface, which produces an askew fragment flyout of fragments 50.

Figure 6:
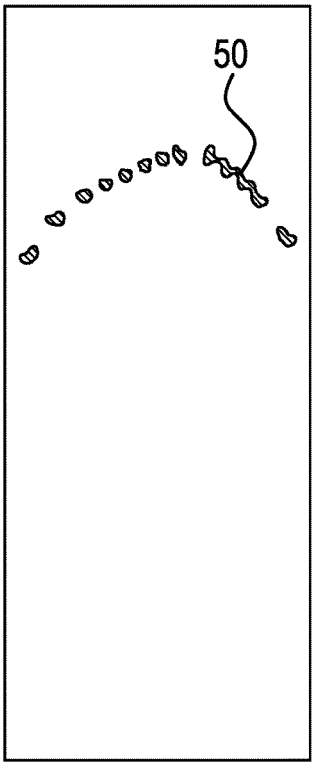
FIG. 6 illustrates a fragmentation pattern of one configuration of the munition of FIG. 5.

FIG. 6 shows an array of the fragments 50 produced by detonation of the explosive charge 42, in a situation where the explosive 44 has a higher detonation velocity than the explosive 46. The fragments 50 skew away from the higher-detonation-velocity explosive 44.

Figure 7:
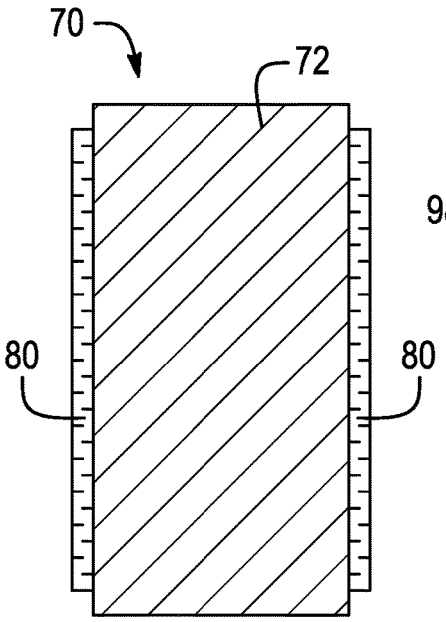
FIG. 7 shows a sectional view of a munition according to a further embodiment.

FIG. 7 shows another arrangement, a munition 70 with an explosive charge 72 having different explosive characteristics in different parts (locations), and with fragments 80 around a perimeter (circumference, in the case of a cylinder) of the explosive charge 72. The explosive characteristics (such as detonation velocity) can be varied in different parts of the explosive charge 72 to achieve different fragment patterns for flyout of the fragments 80 when the explosive charge 72 is detonated. Many arrangements of explosives within the explosive charge 72 are possible; some of these possible arrangements are described herein. Both the arrangement and the characteristics of the explosives involved affect the fragment pattern.

Figure 8:
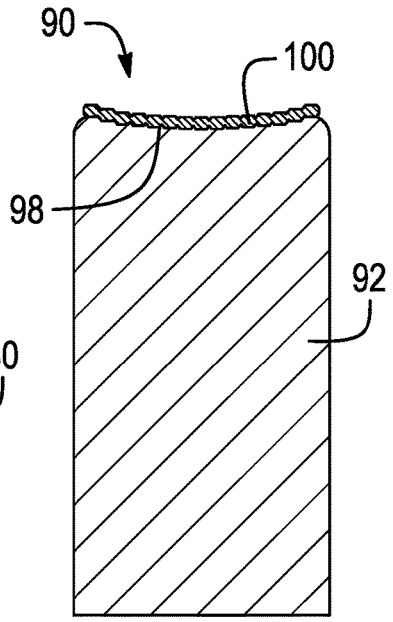
FIG. 8 shows a sectional view of an explosively formed penetrator munition, according to an embodiment.

FIG. 8 illustrates a munition 90, an explosively formed penetrator. The munition 90 has an explosive charge 92 having different explosive characteristics in different parts (locations), and a metal layer 100 on one face 98 of the explosive charge 92. Detonation of the explosive charge 92 transforms the metal layer 100 into an explosive penetrator with a kinetic energy capable of penetrating a target, for example penetrating through metal or concrete. Different configurations of the explosive charge 92 can result in different characteristics of the penetrator, varying (for example), the direction, spread, and/or energy of the penetrator. An example material for the metal layer 100 is copper.

Figure 9:
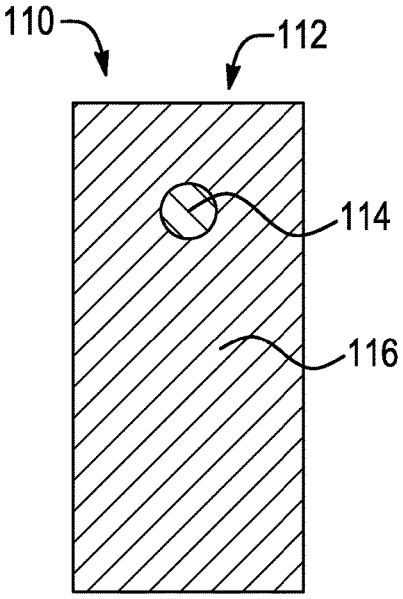
FIG. 9 shows a sectional view of a munition according to a still further embodiment.

Many other explosive charge configurations are possible. FIG. 9 shows a munition 110 that has an explosive charge 112 which has a first explosive 114 within a second explosive 116, the explosives 114 and 116 having different characteristics such as different detonation velocities. The first explosive 114 is spherical, fully surrounded by (embedded in) the second explosive. The explosive charge 112 may be used in conjunction with fragments, to produce a fragmentation munition, and/or with a material layer, to produce an explosively-formed penetrator munition, as described in other embodiments.

Figure 10:
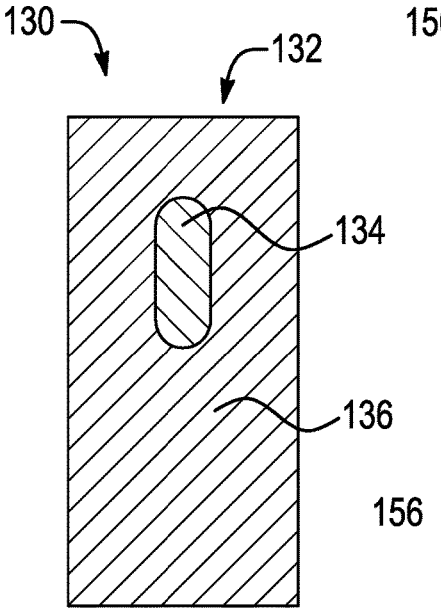
FIG. 10 shows a sectional view of a munition according to another further embodiment.

A wide variety of other shapes for an embedded explosive are possible. FIG. 10 shows one, in a munition 130 that has an explosive charge 132 that includes a rounded-end cylinder first explosive 134 surrounded by (embedded in) a second explosive 136. The embedded explosive 134 may be a higher-detonation-velocity explosive, or may be a lower-detonation-velocity explosive, relative to the explosive 136. The configuration (shape) and/or characteristics of the different explosive materials affect the pressure configuration resulting from detonation of the explosive charge 132.

Many spatial configurations are possible for multiple explosives having different explosive characteristics. In a cylindrical explosive charge, one of the explosives may surround the other explosives, different of the explosives may be along different parts of a perimeter (circumferences) of the explosive charge, and the explosives may be axisymmetric or nonaxisymmetric.

Figure 11:
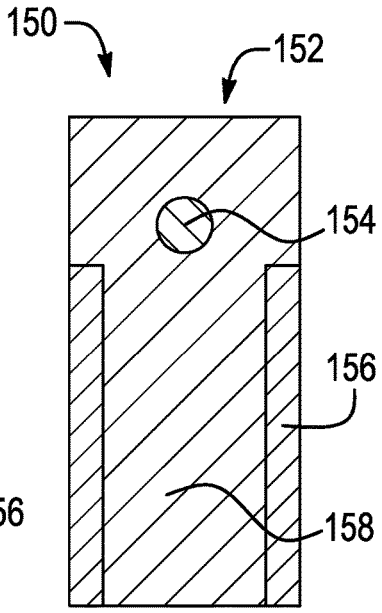
FIG. 11 shows a sectional view of a munition according to yet another embodiment.

As another alternative the explosive charge may include three or more explosives that have different characteristics. An example, shown in FIG. 11, is a munition 150 that has an explosive charge 152 that includes a first explosive 154, a second explosive 156, and a third explosive 158. The explosives 154, 156, and 158 may all have different characteristics, for example different detonation velocities. The characteristics may be selected, and/or the explosives 154, 156, and 158 may be arranged, so as to obtain a desired outcome from detonation of the explosive charge 152. For example, a desired flyout arrangement of fragments may be obtained.

Figure 12:
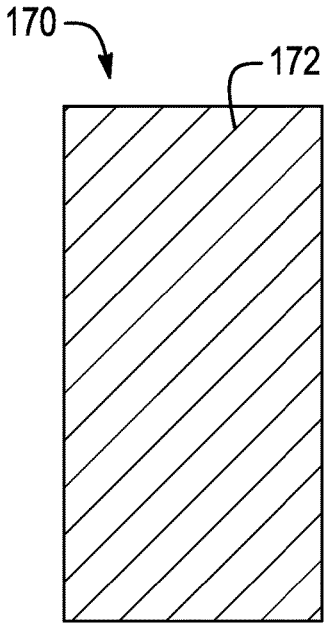
FIG. 12 shows a sectional view of a munition according to still another embodiment.

FIG. 12 illustrates another possibility, a munition 170 with an explosive charge 172 having a graded composition, rather than different explosives with one or more distinct boundaries between them. The graded composition may vary the characteristics of the explosive material continuously from one part of the explosive charge 172 to another part of the explosive charge 172. The variation of explosive characteristics may be greater in some parts of the explosive charge 172 than in others, it is possible that in some portions of the explosive charge 172 there may be constant (or nearly constant) explosive characteristics. Thus the graded composition may be continuous or variable in its grading, and may be confined to only one or more parts of the graded explosive charge 172, such as in the region (or regions) corresponding to a boundary (or boundaries) between different explosives, for instance in the other embodiments described herein.

Figure 13:
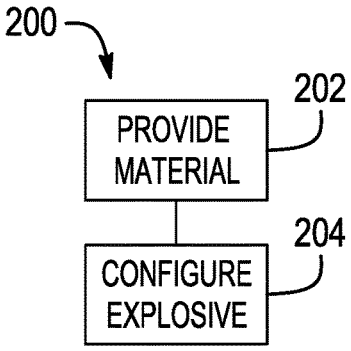
FIG. 13 is a high-level flow chart of a method, according to an embodiment.

FIG. 13 shows a high-level flow chart of a method 200 for configuring a munition, such as the various munitions described herein. In step 202 a material is provided to be propelled from the munition. The material can be fragments, or a layer of material to be propelled as an explosively formed penetrator.

In step 204 an explosive charge with a nonuniform detonation velocity, operatively coupled to the material to be propelled, is configured to achieve a desired configuration of the material when propelled from the munition by detonation of the explosive charge.

Figure 14:
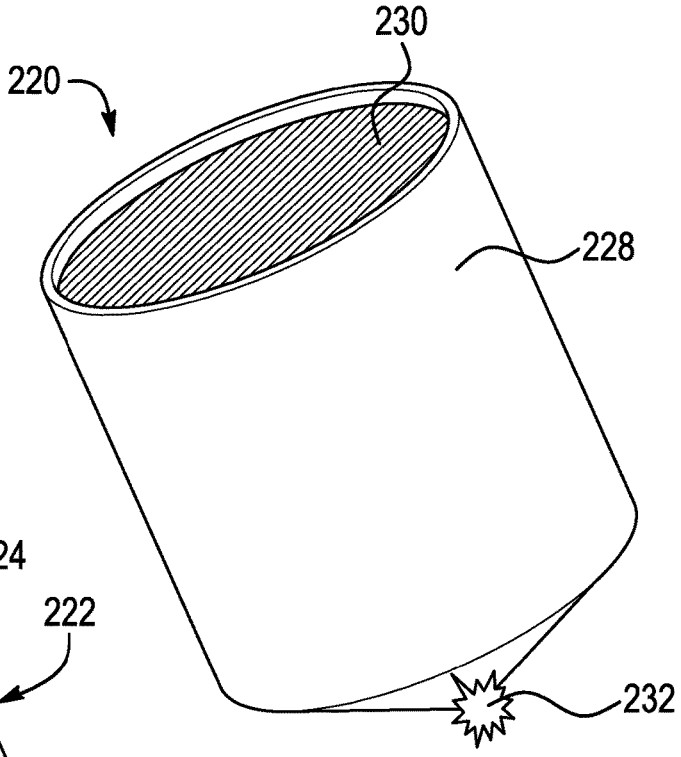
FIG. 14 shows an oblique view of a munition according to an embodiment.
Figure 15:
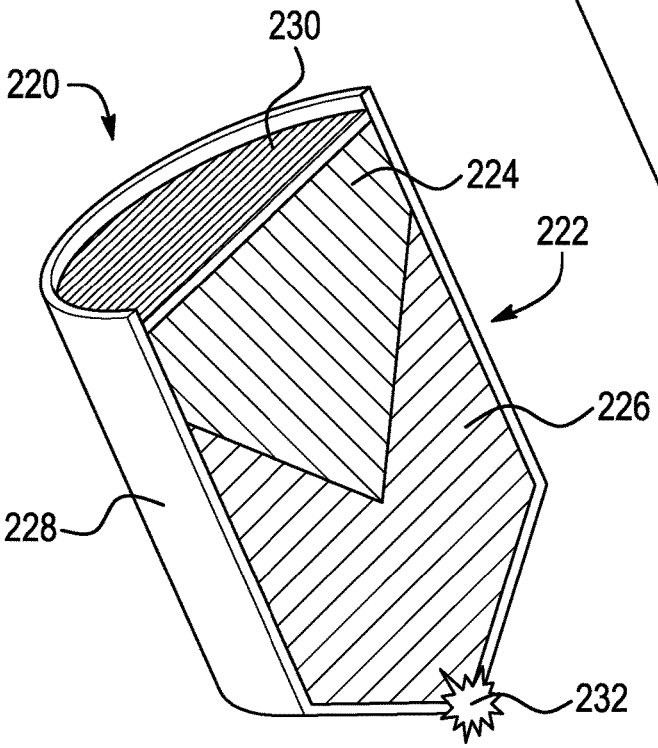
FIG. 15 shows a cutaway view of the munition of FIG. 14.

FIGS. 14-27 show further embodiments. FIGS. 14 and 15 show a munition 220 that includes an explosive charge 222 with a first explosive 224 and a second explosive 226. The explosive charge 222 is used for expelling fragments 230 from a housing 228, when detonated at a detonation point 232. When the first explosive 224 is a (relatively) "slow" explosive (lower detonation velocity), and the second explosive 226 is a (relatively) "fast" explosive (higher detonation velocity), the fragments 230 fly out at a tighter pattern, with velocities that are more uniform, relative to a munition with a uniform explosive charge. This may increase lethality.

Figure 16:
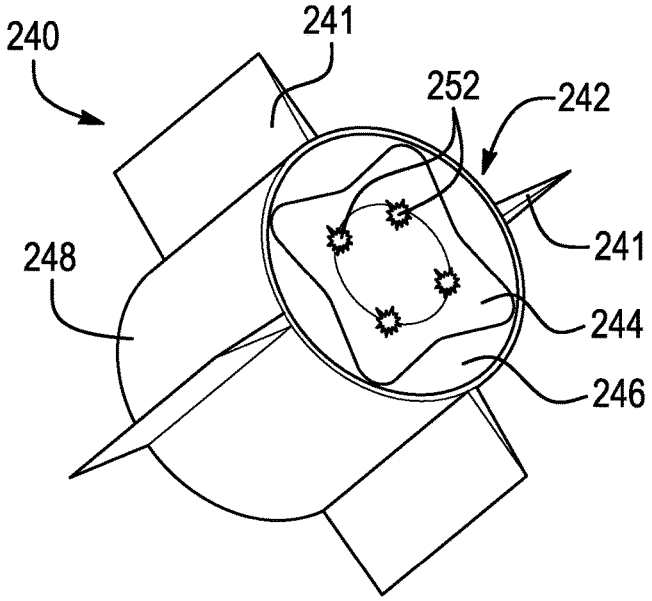
FIG. 16 shows an oblique view of a munition according to an embodiment.
Figure 17:
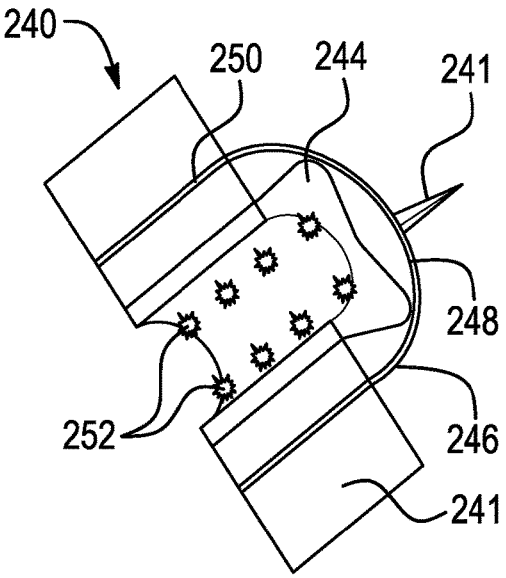
FIG. 17 shows a cutaway view of the munition of FIG. 16.

FIGS. 16 and 17 show a finned munition 240 having fins 241 around a housing 248. The munition 240 may have fragments 250 around the inner surface of the housing 248, or may itself break up into fragments upon detonation of an explosive charge 242 at detonation points 252. The explosive charge 242 may have an annular cylindrical shape, with a first inner explosive 244 having a rounded cruciform shape, and a second outer explosive 246 between the inner explosive 244 and the housing 248.

Figure 18:
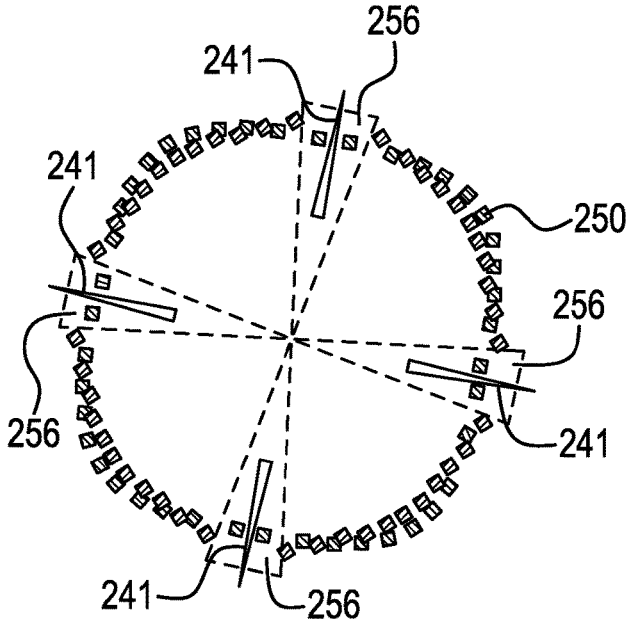
FIG. 18 illustrates a fragmentation pattern produced by the munition of FIG. 16.

With reference in addition to FIG. 18, the first explosive 244 may be a slow explosive, and the second explosive 246 may be a fast explosive. This may make for a more uniform pattern fragments 250, relative to a similar munition with a uniform explosive charge. In particular the explosive charge 242 may drive some of the fragments 250 in an otherwise-fragment-free "cones of life" 256 in the vicinity of the of the fins 241. This may improve lethality and/or simplify fuzing.

Figure 19:
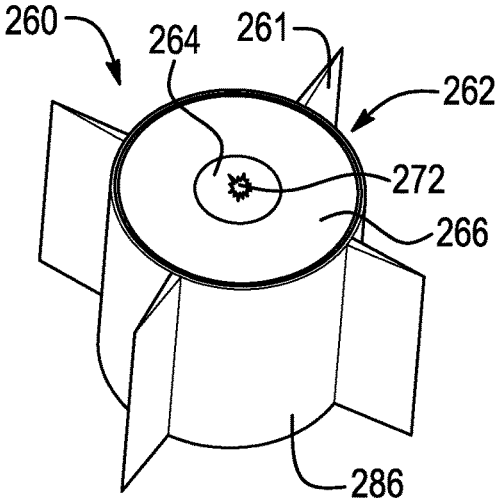
FIG. 19 shows an oblique view of a munition according to an embodiment.
Figure 20:
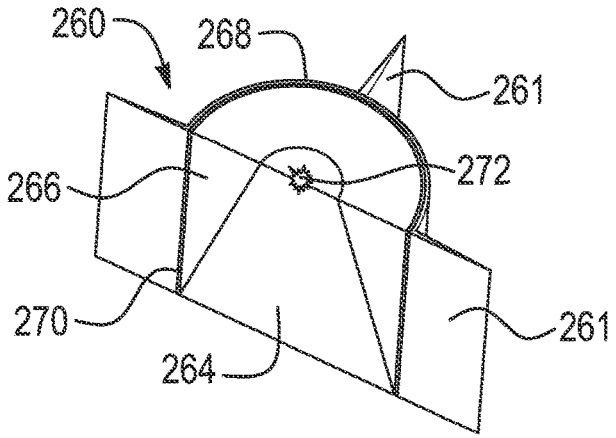
FIG. 20 shows a cutaway view of the munition of FIG. 19.
Figure 21:
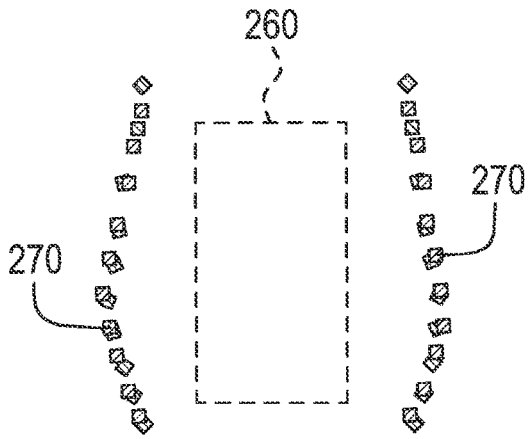
FIG. 21 illustrates a fragmentation pattern produced by an embodiment of the munition of FIG. 18.

FIGS. 19 and 20 show another embodiment, a munition 260 having a cylindrical explosive charge 262 that includes a first explosive 264 and a second explosive 266. The explosive charge 262 is in a housing 268 that may include fins 261, and that may contain fragments 270 or may break up into fragments. The first explosive 264 may have the shape of a trapezoid of revolution, centrally located, coaxial with a longitudinal axis of the housing 268. The second explosive 266 may fill the space between the first explosive 264 and the housing 268. The explosive charge 262 may be detonated at a detonation point 272, which may be on at the center of an end surface of the first explosive, at the narrow end of the first explosive 264.

The first explosive 264 may be faster than the second explosive 266. Alternatively the second explosive 266 may be faster than the first explosive 264. In a configuration where the first explosive 264 is the "fast" explosive, the fragments may form a tighter pattern, with more uniform velocities, than for a similar munition with a uniform explosive charge.

Figure 22:
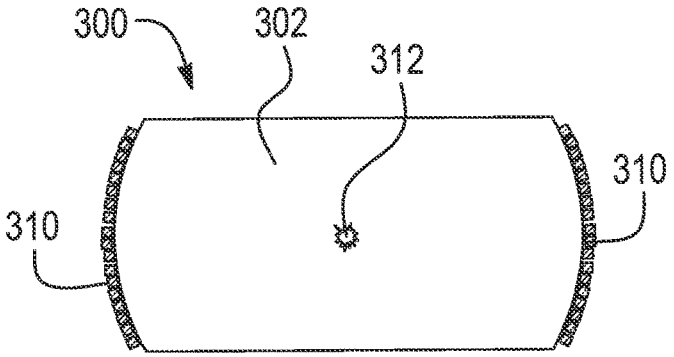
FIG. 22 shows a sectional view of a prior art munition.

FIG. 22 shows a prior art munition 300, for example as part of a missile, that has a uniform explosive charge 302 configured to be detonated at a detonation point 312 to produce a football-shaped fragmentation pattern from fragments 310 on outer faces of the explosive 302. This may be a desirable fragment pattern for engaging certain types of targets.

Figure 23:
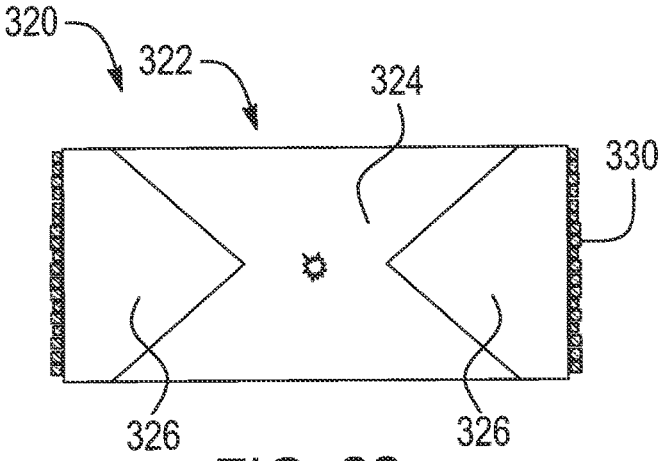
FIG. 23 shows a sectional view of a munition according to an embodiment.

FIG. 23 shows a munition 320 that is configured to achieve a similar fragmentation pattern to the munition 300 (FIG. 22). The munition 320 has an explosive charge 322 that includes a first (slow) explosive 324 located at a center of the explosive charge 322, with wider portions above and below a central detonation point 332. A second (fast) explosive is outward of the first explosive 324. Fragments 330 are on outer faces of the second explosive 326.

The explosive charge 322 advantageously fills the billet, rather than leaving empty space as with the munition 300 (FIG. 22). This avoids fragments ejecting into a missile skin with sub-optimal acceleration, causing more velocity losses at the top and bottom of the munition 300, where the spaces are larger. The fragments 330 for the munition 320 fly out unimpeded by secondary impact with the missile skin, thus resulting higher velocity. The full-caliber explosive billet of the munition 320 produces more optimal fragment velocities and blast effects. Thus lethality may be enhanced.

Figure 24:
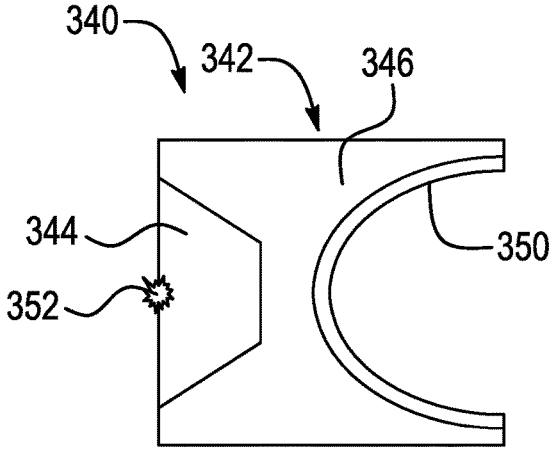
FIG. 24 is a side sectional view of a munition for producing a shaped-charge jet.

FIG. 24 shows a munition 340 having an explosive charge 342, including a first (slow) explosive 344 and a second (fast) explosive 346. The explosive charge 342 is detonated at a detonation point 352 on a surface of the first explosive 344 on an opposite end of the munition 340 from a curved metal layer 350. The metal layer 350 is formed by the detonation into a shape-charge jet.

Figure 25:
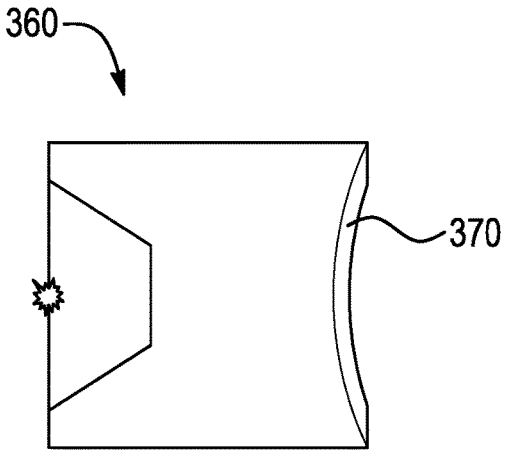
FIG. 25 a side sectional view of another embodiment munition for producing an explosively-formed penetrator.

FIG. 25 shows a munition 360 that is similar to the munition 340 (FIG. 24), but with a metal layer 370 that is flatter (shallower) than the metal layer 350 (FIG. 24). The metal layer 370 may be formed by detonation into an explosively-formed penetrator. The characteristics of the explosives involved, their arrangement, and the arrangement of the metal layer, all may affect the configuration and/or other characteristics of the jet and/or penetrator produced. Other aspects of the munition 360 may be similar to those of the munition 340.

Figure 26:
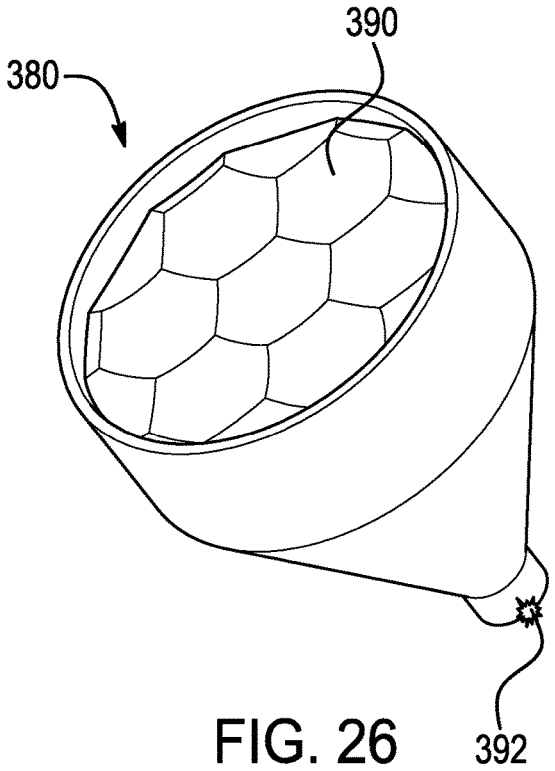
FIG. 26 is an oblique of a munition of an embodiment.
Figure 27:
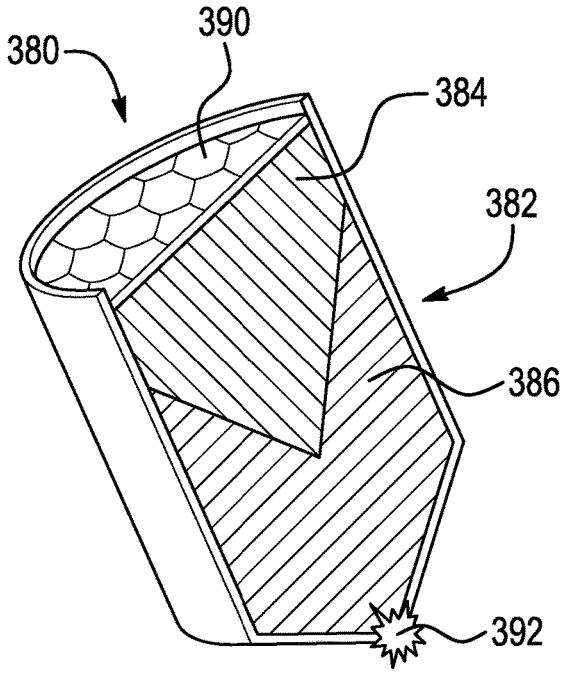
FIG. 27 is a cutaway view of the munition of FIG. 26.

FIGS. 26 and 27 show another embodiment, a munition 380 having a multi-explosive explosive charge 382 for producing multiple explosive-formed penetrators from a metal layer 390 having a series of depressions or recesses. The explosive charge 382 may have a first explosive 384 and a second explosive 386, and may be detonated at a detonation point 392 along the second explosive 386, at an opposite end of the munition 380 from the metal layer 390. In one embodiment the first explosive 384 may be a slow explosive, and second explosive may be a fast explosive.

Although the disclosure has been shown and described with respect to a certain embodiment or embodiments, equivalent alterations and modifications will occur to others skilled in the art upon the reading and understanding of this specification and the annexed drawings. In particular regard to the various functions performed by the above described elements (components, assemblies, devices, compositions, etc.), the terms (including a reference to a "means") used to describe such elements are intended to correspond, unless otherwise indicated, to any element which performs the specified function of the described element (i.e., that is functionally equivalent), even though not structurally equivalent to the disclosed structure which performs the function in the herein illustrated exemplary embodiment or embodiments of the disclosure. In addition, while a particular feature of the disclosure may have been described above with respect to only one or more of several illustrated embodiments, such feature may be combined with one or more other features of the other embodiments, as may be desired and advantageous for any given or particular application.

What is claimed is:

1. A munition comprising:

a housing having a longitudinal axis;

an initiator positioned aft of the housing an explosive charge including a first explosive with a first detonation velocity and a second explosive with a second detonation velocity positioned end-to-end in the housing along the longitudinal axis, one of the first and second explosives positioned in the bottom of the housing and coupled to the initiator, the other of the first and second explosives positioned forward of and in contact with that explosive in the housing;

wherein the first and second explosives have a conical interface about the longitudinal axis;

wherein the first and second detonation velocities are different;

a metal layer in contact with a forward surface of the forward positioned explosive, said metal layer configured to propel multiple fragments, a single or multiple explosively formed penetrators (EFPs) or a singular shaped-charge jet (SCJ) forward in a pattern upon detonation of the second and first explosives, wherein said explosive charge propels the fragments, EFPs or SCJ in a more uniform pattern than the same explosive charge having a single explosive in the housing.

2. The munition of claim 1, wherein the first explosive has a relatively low detonation velocity and the second explosive has a relatively high detonation velocity, wherein the first explosive is positioned in the bottom of the housing and coupled to the initiator and second explosive is positioned forward, wherein the first explosive has a forward-facing conical protrusion in contact with an aft-facing surface of a complementary conical void in the second explosive.

3. The munition of claim 1, wherein the first explosive has a relatively low detonation velocity and the second explosive has a relatively high detonation velocity, wherein the first explosive is positioned in the bottom of the housing and coupled to the initiator and second explosive is positioned forward, wherein the second explosive has an aft-facing conical protrusion in contact with an forward-facing surface of a complementary conical void in the first explosive.

4. The munition of claim 1, wherein the first explosive has a relatively high detonation velocity and the second explosive has a relatively low detonation velocity, wherein the first explosive is positioned in the bottom of the housing and coupled to the initiator and second explosive is positioned forward, wherein the first explosive has a forward-facing conical protrusion in contact with an aft-facing surface of a complementary conical void in the second explosive.

5. The munition of claim 1, wherein the first explosive has a relatively high detonation velocity and the second explosive has a relatively low detonation velocity, wherein the first explosive is positioned in the bottom of the housing and coupled to the initiator and second explosive is positioned forward, wherein the second explosive has an aft-facing conical protrusion in contact with an forward-facing surface of a complementary conical void in the first explosive.

6. A munition comprising:

a housing having a longitudinal axis; and an explosive charge in the housing, the explosive charge including a first explosive located at a center of the explosive charge with wider portions above and below a central detonation point and a second explosive spaced radially outward and on opposing sides of the longitudinal axis and the first explosive, wherein the first explosive has a relative low detonation velocity that is lower than the second explosive's relatively high detonation velocity;

wherein detonation of the first explosive at the central detonation point and then detonation of the second explosive propels the fragments radially outward in a pattern;

wherein said explosive charge propels the fragments in a more uniform pattern than the same explosive charge having a single explosive in the housing.

7. A munition comprising:

a housing having a longitudinal axis;

an initiator positioned aft of the housing an explosive charge including a first explosive with a relatively low detonation velocity and a second explosive with a relatively high detonation velocity positioned end-to-end along the longitudinal axis, the relatively low detonation velocity being lower than the relatively high detonation velocity, the first explosive coupled to the initiator, the first explosive embedded in the second explosive in an aft portion of the housing, said second explosive positioned forward of the first explosive to fill a forward portion of the housing; and a curved metal layer in contact with a forward surface of the second explosive, said curved metal layer configured to form a single shaped-charge jet (SCJ) or a single explosively-formed penetrator (EFP) upon detonation of the first and then second explosives;

wherein the initiator creates a spherical detonation wave that propagates through the first explosive;

wherein the second explosives shapes the spherical detonation wave to form a planar detonation wave that contacts the curved metal later to form the single SCJ or single EFP.

* * * * *